US009249671B2

(12) United States Patent
Butler

(10) Patent No.: US 9,249,671 B2
(45) Date of Patent: Feb. 2, 2016

(54) METHOD AND A DEVICE OF TANGENTIALLY BIASING INTERNAL COOLING ON NOZZLE GUIDE VANES

(75) Inventor: David Butler, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 1004 days.

(21) Appl. No.: 13/393,304

(22) PCT Filed: Sep. 4, 2009

(86) PCT No.: PCT/EP2009/006452

§ 371 (c)(1),
(2), (4) Date: Apr. 25, 2012

(87) PCT Pub. No.: WO2011/026503

PCT Pub. Date: Mar. 10, 2011

(65) Prior Publication Data

US 2012/0201667 A1 Aug. 9, 2012

(51) Int. Cl.
*F01D 5/18* (2006.01)
*F01D 9/04* (2006.01)

(52) U.S. Cl.
CPC ..... *F01D 5/186* (2013.01); *F01D 9/041* (2013.01); *F05D 2240/12* (2013.01); *F05D 2240/126* (2013.01); *F05D 2250/51* (2013.01)

(58) Field of Classification Search
CPC ..... F01D 25/14; F05D 2240/12; F05D 2240/126; F05D 2250/51
See application file for complete search history.

(56) References Cited

U.S. PATENT DOCUMENTS

| | | | | |
|---|---|---|---|---|
| 4,054,030 | A * | 10/1977 | Pedersen | 60/262 |
| 4,785,624 | A | 11/1988 | Smith et al. | |
| 5,839,878 | A * | 11/1998 | Maier | 415/209.2 |
| 2003/0161719 | A1 | 8/2003 | Friedl et al. | |
| 2003/0170113 | A1 | 9/2003 | Abuaf | |
| 2004/0115054 | A1 | 6/2004 | Coulon | |
| 2005/0135921 | A1 | 6/2005 | Powis | |
| 2008/0095635 | A1* | 4/2008 | Chon | 416/97 R |
| 2009/0185893 | A1 | 7/2009 | Propheter-Hinckley | |
| 2014/0147259 | A1* | 5/2014 | Reilly et al. | 415/178 |

FOREIGN PATENT DOCUMENTS

| | | | |
|---|---|---|---|
| CA | 2596040 | A1 | 2/2009 |
| CN | 1467366 | A | 1/2004 |
| EP | 0980960 | A | 2/2000 |
| EP | 1039096 | A | 9/2000 |
| EP | 1039096 | A2 | 9/2000 |

(Continued)

*Primary Examiner* — Nathaniel Wiehe
*Assistant Examiner* — Michael Sehn

(57) ABSTRACT

A deflector for guiding a cooling fluid to a blade device of a turbine is provided. The deflector includes a first opening region with a first opening shape and a second opening region with a second opening shape. The deflector is connectable to a first blade device and to a second blade device in such a way that the cooling fluid is streamable through the first opening region into the first blade device and the cooling fluid is streamable through the second opening region into the second blade device. The first opening shape differs from the second opening shape for achieving a predetermined first mass flow of the cooling fluid into the first blade device and a predetermined second mass flow of the cooling fluid into the second blade device at predetermined installation locations of the first blade device and the second blade device.

13 Claims, 4 Drawing Sheets

(56) References Cited

FOREIGN PATENT DOCUMENTS

| | | | |
|---|---|---|---|
| EP | 1319806 | A2 | 6/2003 |
| EP | 1342883 | A2 | 9/2003 |
| EP | 1544414 | A1 | 6/2005 |
| GB | 641146 | A | 8/1950 |
| GB | 2450405 | A | 12/2008 |
| RU | 2325337 | C2 | 2/2008 |
| WO | WO 9947792 | A1 | 9/1999 |

* cited by examiner

METHOD AND A DEVICE OF TANGENTIALLY BIASING INTERNAL COOLING ON NOZZLE GUIDE VANES

CROSS REFERENCE TO RELATED APPLICATIONS

This application is the US National Stage of International Application No. PCT/EP2009/006452, filed Sep. 4, 2009 and claims the benefit thereof. All of the applications are incorporated by reference herein in their entirety.

FIELD OF INVENTION

The present invention relates to a deflector for guiding a cooling fluid to a blade device of a turbine. Furthermore, the present invention relates to a blade assembly of a turbine comprising the deflector. Moreover, the present invention relates to a method of producing the deflector for guiding a cooling fluid to a blade device of a turbine.

ART BACKGROUND

In conventional gas turbines a combustor is made from a number of individual burners which feed hot gas into a first stage with nozzle guide vanes that are located downstream of the combustor. The guide vanes direct the hot gases from the individual burners and the air from the compressor stage in a predetermined direction. Moreover, the guide vanes comprise nozzles through which cooling air may be exhausted in order to cool the surfaces of the guide vanes.

In a conventional combustor stage of the turbine, a number of individual burners are located circumferentially around the centre of the turbine. Thus, there is some tangential gas temperature variation associated with the flow of the hot gases from the individual combustors in the downstream direction. As the number of individual burners decrease, the amount of tangential gas temperature variation increases because between the burners a lower temperature is generated and close to the burners a higher temperature is generated.

This tangential temperature variation leads to a varying temperature profile at each downstream nozzle guide vane, wherein the temperature profile on each nozzle guide vane is dependent on the position of the nozzle guide vane relative to the individual burners, i.e. relative to the installation location of the nozzle guide vane inside the turbine.

The metal temperature is a critical aspect to the life of each nozzle guide vane. The metal temperature may be controlled by the use of cooling air. However, a use of an excessive amount of cooling air reduces the power and efficiency of the gas turbine. In conventional cooling systems, the amount of cooling air has to be biased to match the gas temperature profile for the nozzle guide vane that is exposed to the hottest temperature so that all nozzle guide vanes have the same acceptable life.

A conventional nozzle guide vane (NGV) comprises a plurality of holes through which a cooling fluid may be exhausted for providing a film cooling on the surfaces of the NGV. The NGV may comprise impingement plates or tubes that are used to meter the air into the correct locations. These impingement plates or tubes are located within the NGV for cooling the inner wall of the NGV.

In a conventional embodiment of the impingement cooling system, the cooling air that streams within each NGV, in particular within the impingement plates or tubes, is for all installed NGVs the same or is controlled by complex biasing valves.

CA 2 596 040 A1 discloses a cooling air distribution system that distributes the cooling air upstream of the leading edge of a guide vane aerofoil. A plurality of openings are installed into a support flange so that cooling air may be injected inside a combustion zone for cooling the leading edge of a guide vane aerofoil from the outside.

EP 1 039 096 A2 discloses a guide vane in which an impingement tube is installed. The impingement plate comprises exhaustion holes that guide cooling air to the inner surface of the guide vane for cooling the inner wall of the guide vane.

EP 1 544 414 B1 discloses a guide vane that comprises an impingement tube with exhaustion holes for guiding cooling air from the inside to the inner wall surface of the guide vane. Some exhaustion holes for the cooling fluid of a guide vane may differ to adjacent exhaustion holes of adjacent guide vanes.

EP 1 319 806 A2 and U.S. Pat. No. 4,785,624 disclose complex adjustment devices such as biasing valves and adjustment systems for adjusting the size of an exhaustion hole.

GB 2 450 405 A discloses a gas turbine nozzle with differently cooled vanes, wherein the differences in cooling may be achieved by varying the configuration of film cooling holes and the thickness of thermal barrier coating.

SUMMARY OF THE INVENTION

It may be an object of the present invention to provide a proper cooling system for a turbine.

In order to achieve the object defined above, a deflector for guiding a cooling fluid to a blade device of a turbine, a blade assembly of a turbine comprising the deflector and a method of producing the deflector for guiding a cooled fluid to a blade device of a turbine according to the independent claims are provided. The dependent claims describe advantageous developments and modifications of the invention.

According to a first exemplary embodiment of the present invention, a deflector for guiding a cooling fluid to a blade device of a turbine is provided. The deflector comprises a first opening region with a first opening shape and a second opening region with a second opening shape. The deflector is connectable to a first blade device and to a second blade device in such a way that the cooling fluid is streamable through the first opening region into the first blade device and the cooling fluid is streamable through the second opening region into the second blade device. The first opening shape differs from the second opening shape for achieving a predetermined first mass flow of the cooling fluid into the first blade device and a predetermined second mass flow of the cooling fluid into the second blade device at predetermined installation locations of the first blade device and the second blade device.

Advantageously the first opening shape defines a first flow rate cross section and the second opening shape defines a second flow rate cross section, through which cooling fluid can pass, with the first flow rate cross section being different from the second flow rate cross section. This may result in a difference between the first mass flow and the second mass flow so that depending upon the first opening shape and the second opening shape a specific amount of cooling fluid can be directed to the first blade device and a different but also specific amount of cooling fluid can be directed to the second blade device.

According to a further exemplary embodiment of the present invention, a blade assembly of a turbine is provided, wherein the blade assembly comprises a first blade device, a second blade device and an above-described deflector.

According to a further exemplary embodiment of the present invention, a method of producing a deflector for guiding a cooling fluid to a blade device of a turbine is provided. According to the method, an ambient heat at a predetermined installation location of a blade device in the turbine may be determined. For achieving a predetermined cooling effect of the blade device at the predetermined installation location, a predetermined local mass flow of the cooling fluid into the blade device is determined or calculated. In the deflector an opening region is formed, so that the predetermined local mass flow of the cooling fluid is streamable into the blade device.

The blade device of the turbine may denote an aerofoil, a rotor blade, a stator blade or a guide vane, in particular a nozzle guide vane (NGV), of a gas turbine.

The deflector may be formed of a plate-like element, wherein heat resistant materials, such as metal, ceramic or other suitable heat resistant materials, are used. The first and second opening regions may describe a region through which the cooling fluid may stream inside the blade device or an impingement tube located inside the guide vane. The shape of each first and second opening region may define the mass flow volume that may stream through the deflector into the first or second blade device. The shape of the first and/or the second opening region may provide a variety of different shapes, such as circular, rectangular or other polygon shapes, a variety of sizes, and a variety of orientations in respect to the cooling fluid streaming direction. In other words, the shape of the first and/or the second opening region may define the streaming capability of the mass flow inside the first or second blade device.

According to a further exemplary embodiment, the deflector may comprise more than two first and/or second opening regions as well, so that one deflector element may comprise a plurality of opening regions that are connectable to a plurality of respective blade devices. Moreover, the one deflecfor may be connected to a plurality of blade assemblies around a section of a carrier device of the turbine. The deflector may be for instance spring loaded with respect to the carrier device, so that the deflector may be fixed to the carrier device by a press fitting.

The term "predetermined installation location" may denote a unique installation location of the blade device inside the turbine, i.e. The term "predetermined installation location" may denote the location where the first and the second blade device is envisaged to be installed inside the turbine. In particular, turbines and gas turbines comprise a circumferential cross-section wherein on its tangential positions, e.g. closed to a tube-shaped housing of the turbine, the individual burners are installed and the hot gas of the individual burners is injected. The predetermined installation locations are in particular defined by the tangential position of the blade devices with respect to an exhaustion location of the hot gas out of the individual burners, in order to guide the hot exhaustion gases of the burners and/or the compressor stage in a predefined direction. For example a first blade device may be located right in the centre of a hot exhaustion gas provided by a first combustion chamber, whereas a second blade device may be located off this centre or maybe just in between two combustion chambers, so that the second blade device does not get hit by the major stream of hot exhaustion gases, but by two secondary streams from the two combustion chambers. Therefore the number and positions of the combustion chambers but also the form and length of a transition duct between the combustion chambers and the beginning of the turbine stage has an effect on the local distribution of the hot gases.

For defining the mass flow of cooling fluid at the predetermined installation location of the first and/or second blade device, an ambient heat at the predetermined installation location of the first and the second blade device in the turbine is known for instance by measuring the temperature or by simulating the turbine under working conditions. If the ambient heat at the predetermined installation location of the blade device is known, the first mass flow and the second mass flow of the cooling fluid may be determined and controlled by the first and second opening region, so that the predetermined first mass flow and second mass flow is streamable inside the blade device for cooling the blade device. Thus, a predetermined cooling effect is achieved for the first and second blade device and the predetermined cooling effect is adapted exactly to the need of each first and second blade device, in particular is adapted to the predetermined installation location of the first and second blade device.

By the present invention, the use of the cooling fluid, in particular the cooling air, may be optimized by adapting the mass flow of cooling fluid individually to each blade device with respect to the predetermined installation location of the blade device. Dependent on the predetermined installation location, the blade device receives the predetermined mass flow of cooling fluid due to the exactly adjusted shape of the opening region in the deflector.

The first opening shape and the second opening shape differ from each other, so that a different first mass flow and second mass flow of the cooling fluid is streamable inside the corresponding first blade device and the second blade device.

In other words, by using the deflector with the first and second opening region for guiding cooling fluid, the deflector partially blocks with the shape of the first opening region and the second opening region the entry of the cooling fluid inside the first and/or the second blade device, so that more or less cooling fluid may enter the different blade devices. The blockage respectively the small-sized opening shape may only be used for blade devices that are not exposed e.g. to the hottest gas temperatures. Mass flows of cooling fluid into blade devices that are exposed to even lower temperatures can be more blocked by a smaller opening shape of the first and/or second opening regions. For the maximum mass flow of cooling fluid into the blade device, the first and/or second opening shape of the first and/or second opening region may comprise the same size as the inner tube of the first and/or second blade device, so that no blockage due to the deflector occurs and a maximum cooling effect and a maximum flow of the mass flow is achieved.

In particular, the deflector is located to a cooling fluid inlet portion of the first and/or the second blade device so that the deflector controls the inflow respectively the injection of the cooling fluid inside the blade device. Hence, when controlling the influx of the cooling fluid into the first and/or second blade device a more exact control of the mass flow may be provided then when providing the outlet respectively the exhaustion of the mass flow outside of the first and/or second blade device. Thus, in an exemplary embodiment, the deflector comprises the first opening region and the second opening region, wherein the deflector is installed for controlling the inflow of the cooling fluid inside the first and/or the second blade device.

By the present invention a simple cooling mechanism for a blade device may be provided. By simply adjusting the shape of the first opening region and/or the second opening region of the deflector according to a predetermined installation location of the first blade device and the second blade device, a specific predetermined cooling effect for the respective blade devices may be provided. Complex biasing systems for the cooling effect may no longer be necessary. Moreover, the deflector may be simply installed to an existing gas turbine, in particular between the blade device and a carrier ring for supporting the blade devices. A retrofitting of the existing gas turbines may be possible. Moreover, because the deflector may be fabricated by simply providing two different shaped opening regions in a plate-like deflector sheet, a simple and inexpensive fabrication method may be provided.

According to a further exemplary embodiment, a first specific pattern of a first connection means may be provided on the deflector. The first specific pattern corresponds to a second specific pattern of the second connection means at a predetermined installation location of the deflector in the turbine.

The first and/or second connection means may comprise for instance a tab or pin on the one side and a corresponding gap acting as corresponding first and/or second connection means on the other side. If, for example, the deflector comprises a first specific pattern of tabs as first connection means, the first specific pattern of tabs may only fit to a corresponding second specific pattern of gaps as a second connection means at the predetermined installation location of the deflector in the turbine. In other words, the specific pattern of the tabs and the specific pattern of the gaps form a unique installation location for the deflector with respect to the turbine. Thus, by the use of the first specific pattern of first connection means and the second specific pattern of the second connection means a coding of the predetermined installation locations may be provided. This leads to a proper installation method of the deflector inside the turbine because the deflector may only be installed to a dedicated and predetermined installation location. The first and second connection means may also be selected from the group consisting of pins and respective holes. The first and second specific pattern may be provided by forming a certain arrangement or a certain diameter of the connection means. The first and second connection means may also comprise ID-tags that comprise the information of the correct installation location of the deflector. Moreover, the second specific pattern of the second connection means may be formed at the first and/or second blade devices, at a (common) base area of the blade devices or at a carrier device, such as a carrier ring of the turbine.

According to a further exemplary embodiment, the first opening region and/or the second opening region comprises a pattern of inlet holes. The first opening shape and the second opening shape may be formed with one inlet hole or with a plurality of inlet holes for the cooling fluid. Thus, due to the pattern of inlet holes a fluid stream characteristic (e.g. desired turbulence inside the blade device) of the cooling fluid may be adapted, so that the cooling effect may be improved.

According to a further exemplary embodiment, the deflector may comprise exhausting holes for exhausting cooling fluid to an environment of the first blade device and/or the second blade device for providing a film cooling on an outer surface of the first blade device and/or the second blade device. Thus, a part of the cooling fluid may be injected through the first and second opening region inside the respective blade devices but also another part of the cooling fluid may be used for being exhausted to an environment of the blade devices. Thus, an outer film cooling that on the outer surface of the blade devices may be provided and similarly an inner cooling effect controlled by the first and second opening shapes of the first and second opening regions may be provided.

According to a further exemplary embodiment of the deflector, the deflector is spatially fixable to a carrier device of the turbine or to the first blade device and/or the second blade device.

According to a further exemplary embodiment of the blade assembly, the assembly comprises the carrier device wherein the carrier device is mounted to the turbine and defines a predetermined installation location of the first blade device and the second blade device with respect to the turbine. According to a further exemplary embodiment, the carrier device is a carrier ring.

The term "carrier device" may denote a device that may support the blade device at the predetermined installation location in the turbine. The carrier device may denote an inner carrier ring that extends circumferentially around the centre of the turbine, wherein the carrier device is adapted for supporting the blade devices. From the inner carrier ring the blade devices may extend in an outside direction (radially outwardly) with respect to the centre of the turbine. Moreover, the carrier device may denote an outer carrier ring from which the blade devices may extend radially inwardly to the centre line of the gas turbine. The carrier device may be a stator carrier ring and may therefore be stationary fixed to the turbine. Moreover, the carrier device may be a rotor carrier ring that is connected to a rotating axis of the turbine and may be adapted for supporting rotor blades in particular of the turbine stage of the gas turbine.

The deflector may be spatially fixed to the carrier device of the turbine or to the first or second blade device, so that the deflector may be pre-assembled either to the carrier device or the blade devices, so that a flexible fabrication method may be provided.

According to a further exemplary embodiment of the blade assembly, the deflector is integrally formed to the first blade device and/or to the second blade device.

By the term "integrally" it may be denoted that the deflector and the first and/or second blade device are made from one piece. In particular, blade devices may be manufactured by using a so-called lost wax casting method wherein internal cooling cavities may be formed. Besides the cooling cavities also the deflector may be formed integrally, so that no further connection and fabrication or installation steps between the deflector and the blade devices may be necessary.

According to a further exemplary embodiment of the blade assembly, the deflector is interposed in between (a) the first blade device and the second blade device and (b) the carrier device in such a way that the gap between the deflector and the carrier device is formed, so that the cooling fluid is streamable through the gap. To the gap, the cooling fluid may be fed. The first opening region and the second opening region of the deflector may be connected to the gap, so that through the opening regions the cooling fluid may flow from the gap inside the first and/or second blade devices. The deflector may thereby cover at least a part of a surface of the carrier device and/or the first and/or the second blade device, so that the cooling fluid may be guided in the gap between the deflector and the surface.

According to a further exemplary embodiment, the deflector comprises a third specific pattern of third connection means and the carrier device comprises a fourth specific pattern of fourth connection means. The third specific pattern corresponds to the fourth specific pattern of the fourth connection means at a predetermined installation location of the deflector.

The third connection means and the fourth connection means may comprise tabs and corresponding gaps that are aligned in a predefined specific pattern, so that the specific pattern of the third connection means fits to the specific pattern of the fourth connection means (exclusively) at the predefined installation location.

By the present invention the use of cooling air may be optimized, so that to each blade device a predetermined respective opening shape of an opening region is allocated dependent on its predetermined installation location (e.g. a tangential position) of the blade device with respect to the turbine. The claimed deflector may be installed in an existing casting of the turbine and may be installed to carrier devices and to blade devices without any modifications of an existing turbine.

The first opening region and/or the second opening region may comprise a certain amount of inlet holes to reduce the amount of cooling fluid being used to cool the blade devices. By applying the claimed deflector, the cooling effect of each blade devices is suited to a specific installation location of the blade device inside the turbine, in particular relatively to the installation location of the burners of the turbine.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
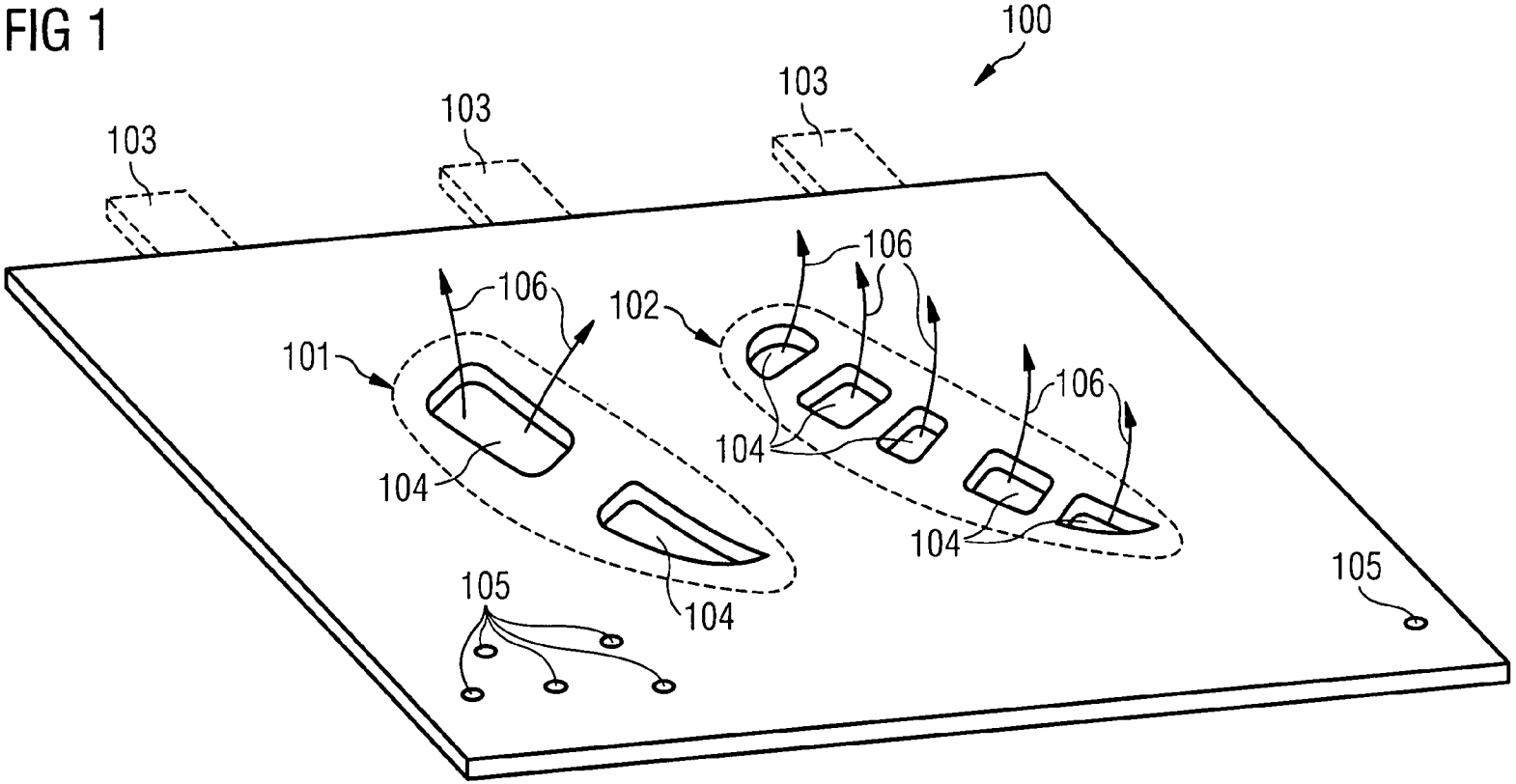
FIG. 1 illustrates a schematical view of an exemplary embodiment of the deflector.

The illustrations in the drawings are schematic. It is noted that in different figures similar or identical elements are provided with the same reference signs.

FIG. 1 shows a deflector 100 for guiding a cooling fluid 106 to a blade device of a turbine. The deflector 100 comprises a first opening region 101 with a first opening shape and a second opening region 102 with a second opening shape. The deflector 100 is connectable to a first blade device 200 (see FIG. 2) and to a second blade device 210 (see FIG. 2) in such a way that the cooling fluid 106 is streamable to the first opening region 101 into the first blade device 200 and the cooling fluid 106 is streamable through the second opening region 102 into the second blade device 210. The first opening shape differs from the second opening shape for achieving a predetermined first mass flow into the first blade device 200 and a predetermined second mass flow into the second blade device 210 at predetermined installation locations of the first blade device 200 and the second blade device 210.

In other words, the first and second opening regions are adapted to an ambient heat at a predetermined installation location of the blade devices 200, 210 in the turbine in such a way that a predetermined mass flow of the cooling fluid 106 is streamable into the blade device 200 for achieving a predetermined cooling effect for the blade devices 200, 210 at the predetermined installation location.

The predetermined installation location may define a predefined position of the first and/or second blade device 200, 210 with respect to the turbine. To each predetermined installation location of the blade devices 200, 210 in the turbine, a predetermined ambient heat may be measured or calculated, so that a predetermined mass flow of the cooling fluid 106 may be determined for achieving a desired cooling effect at the blade devices 200, 210.

The deflector may further comprises exhausting holes 105 for exhausting cooling fluid 106 to an environment of the first blade device 200 and/or the second blade device 210 for providing a film cooling on a supporting surface of the first blade device 200 and/or the second blade device 210

As shown in FIG. 1, the first opening region 101 and the second opening region 102 may comprise a pattern of inlet holes 104 that may define the first opening shape of the first opening region 101 and the second opening shape of the second opening region 102. As shown in FIG. 1, the first opening region 101 having two inlet holes 104 may provide a fluid flow of cooling fluid 106 to the first blade device 200 and the partially blockaded second opening region 102 having five smaller inlet holes 104 may provide the fluid flow of the cooling fluid 106 to the second blade device 210. The first opening shape and the second opening shape may provide, in particular with its inlet holes 104, a partial blockage to restrict the flow of the cooling fluid 106 into the blade device 200, 210. The blockage of the cooling fluid 106 with the first opening shape and the second opening shape may also depend on the pressure with which the cooling fluid 106 is fed through the first and second opening shapes.

The first opening region 101 and the second opening region 102 are shown as dotted lines in the figures because they may not be visible but define only an area in which opening shapes are defined. Additionally the first and second opening regions 101, 102 may represent the entrance to the aerofoil cooling in the nozzle guide vane casting, if it is casted. Therefore in a produced product there may be the form of opening regions 101 and 102 slightly visible, but this is not necessarily the case.

Moreover, as can be seen in FIG. 1, the deflector 100 may comprise first connection means 103 that are attached in a predefined first specific pattern to the deflector 100. In particular, the first connection means 103 may be formed as a tab or pin. FIG. 1 illustrates three possible locations of the first connection means 103 at the deflector 100. The first connection means 103, in particular the tabs, may be located at the left, centre or right part of the deflector 100 (see dotted lines in FIG. 1). In particular, the tab (as the first connection means 103) may only exist in one of the three positions shown as dotted lines in FIG. 1. Where the left, centre or right tab fits to a corresponding left, centre or right (as the second connection means 201) gap at the first blade device 200 and/or the second blade device 210. The position where the pin fits to the gap defines and thus controls the relative position of the deflector 100 relative to the first blade device 200 and/or the second blade device 210 and thus to the centre of the combustor. In other words, via the interface defined by the second connection means 201 the position of the deflector 100 relative to the centre of the combustor may be defined.

Moreover, one, two or three first connection means 103 indicate with the dotted lines in FIG. 1 may be formed. Other locations of the first connection means 103 at the deflector 100 may be possible as well.

The corresponding second connection means 201 (see FIG. 2) may comprise a second specific pattern. The first specific pattern of the first connection means 103 may fit to the second specific pattern of the second connection means 201 (exclusively) at the predetermined installation location of the deflector 100 in the turbine. If, for instance, the first connection means 103 comprises a tab in the left position as seen in FIG. 1, the corresponding second specific pattern of a second connection means 201 may be formed of a gap in which the tab formed on the left side of the deflector 100 as seen in FIG. 1 may fit in. If there would be no gap at the correct position at an installation location, the deflector 100 may not fit to the position because the tab avoids a correct installation of the deflector 100.

Figure 2:
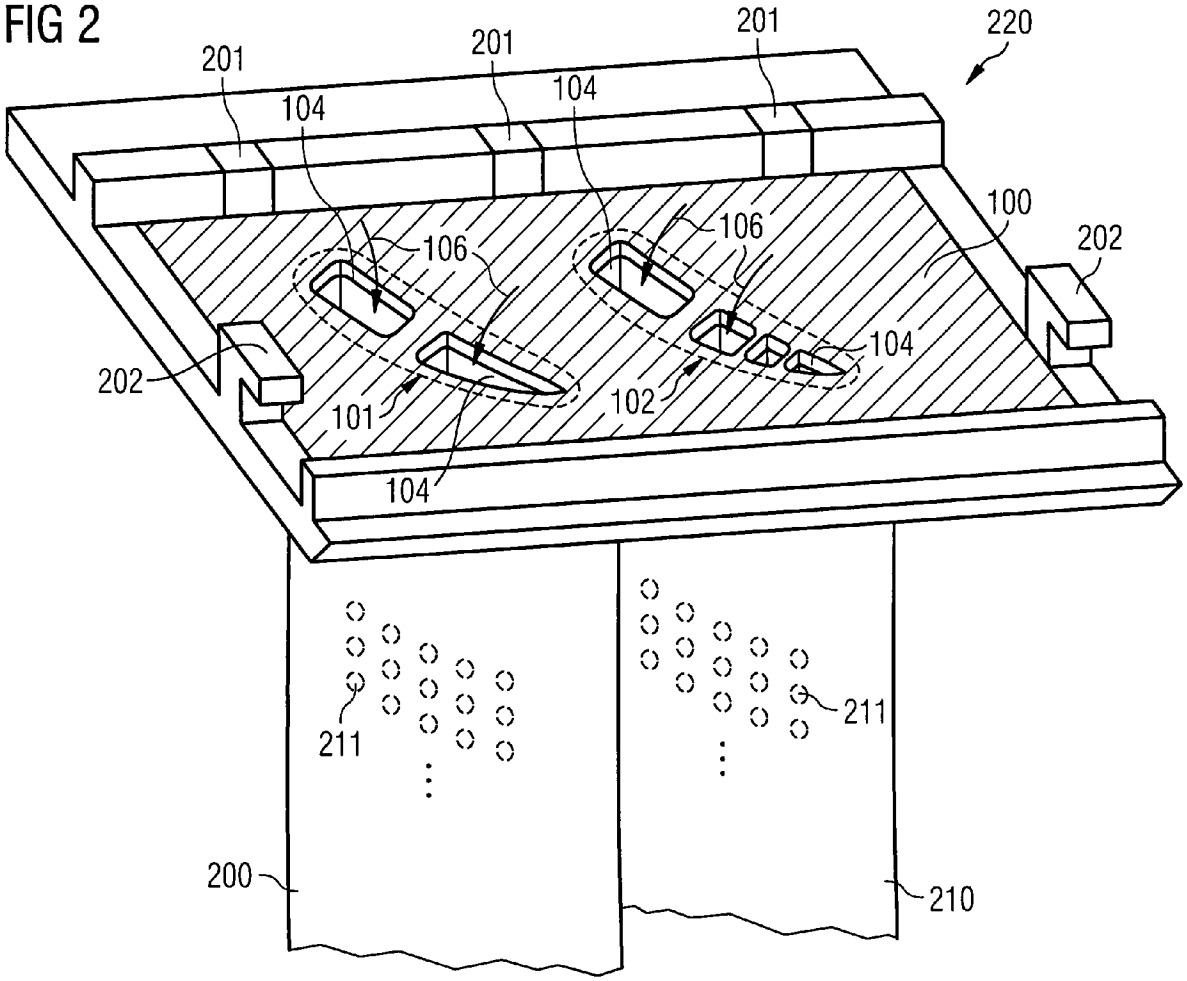
FIG. 2 illustrates an exemplary embodiment of a blade assembly of a turbine with the deflector according to an exemplary embodiment of the present invention.

FIG. 2 illustrates a blade assembly 220 wherein the blade assembly 220 comprises the first blade device 200, the second blade device 210 and the deflector 100. The deflector 100 may be installed to a base area of the first blade device 200 and/or the second blade device 210. To the blade assembly 220 the second connection means 201 may be formed. As shown in FIG. 2 the second connection means 201 form three gaps wherein the location of the three gaps forms the second specific pattern. The deflector 100 has to comprise for its correct installation a first specific pattern of first connection means 103, in particular the correct position of the tabs, so that the first connection means 103 fits into the second connection means 201. The first specific pattern and the second specific pattern are designed in such a way that the deflector 100 is exclusively installable at a unique predetermined installation location. Thus, an incorrect installation of the deflector 100 at a incorrect installation location, where the first opening region 101 and the second opening region 102 may for instance be connected to wrong blade devices 200, 210, may be prevented. At the base area of the first blade device 200 and/or the second blade device 210 a rail may be formed into which the second connection means 201 are formed, e.g. by notching.

As can furthermore be taken from FIG. 2, a third connection means 202 may be formed either to the deflector 100 or to the first blade device 200 and/or the second blade device 210. The third connection means may form a third specific pattern, such as individually formed hooks or clamps, that fit to fourth connection means 301 (see FIG. 3) of a carrier device 300 (see FIG. 3) at an unique predetermined installation location.

For completeness, within the first blade device 200 and the second blade device 210 blade cooling holes 211 are indicated via dotted lines. These may be required to create the necessary pressure drop to allow the deflector 100—which can also be called impingement plate—to work.

Figure 3:
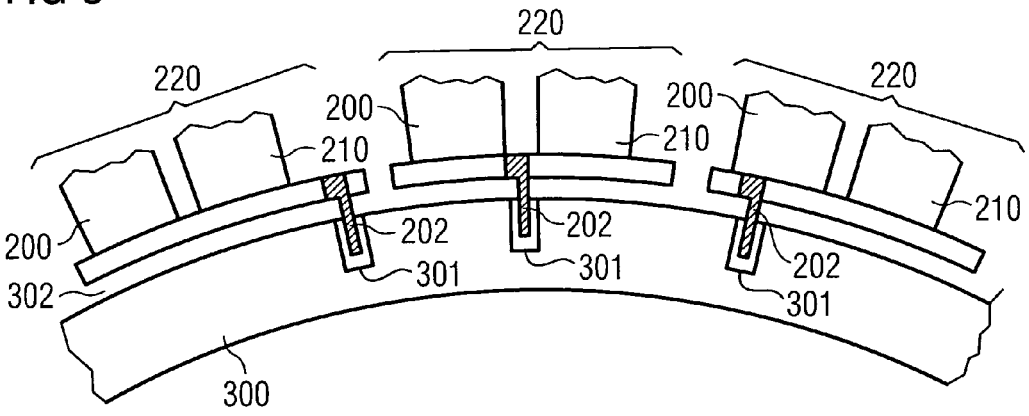
FIG. 3 illustrates a schematical view of the blade assembly according to an exemplary embodiment of the present invention.

FIG. 3 illustrates an exemplary embodiment of the present invention wherein three blade assemblies 220 are attached to the carrier device 300. The carrier device 300 may comprise for instance an inner carrier ring adapted for supporting the blades of a turbine, from which inner carrier ring the first blade devices 200 and the second blade devices 210 extend radially outwardly with respect to the centre axis of the turbine. The carrier device 300 may comprise the fourth connection means 301 that may be formed as gaps into which the third connection means 202 may be engaged. The fourth connection means 301 forms a fourth specific pattern, so that only predefined blade assemblies 220, which comprise a corresponding third specific pattern of third connection means 202, may be attached to the predefined installation location at the carrier device 300 and thus to a predetermined installation location with respect to the turbine. As can be seen in FIG. 3, the left blade assembly 220 comprises on the right side a hook or a pin forming the third connection means 202. Only on the left position of the carrier device 300 the third connection means 202 may be engaged by the fourth connection means 301. The middle or the right blade assemblies 220 may not fit to the carrier device 300 at the left position, because the third specific pattern of the third connection means 202 of the middle or the right blade assemblies 220 is not fittable into the fourth specific pattern of the fourth connection means 301 at the left region of the carrier device 300. Thus, to each blade assembly 220 a predefined unique installation location with respect to the carrier device 300 and thus with respect to the turbine may be determined.

Moreover, as can be seen in FIG. 3, the blade assemblies 220 are spaced from the surface of the carrier device 300, so that a gap 302 is formed. Through the gap 302 the cooling fluid 106 may be fed into the first blade device 200 and/or the second blade device 210. The cooling fluid 106 may be fed by the compressor stage of the turbine into the gap 302.

The blade assemblies 220 are located at the carrier device 300, wherein the carrier device 300 may be the inner carrier ring or an outer carrier ring. The alignment of a certain amount of blade assemblies 220 may form a pattern, wherein the pattern of the blade assemblies 220 may repeat themselves around the circumference of the carrier rings. According to FIG. 3, the pattern of blade assemblies 220 may comprise three blade assemblies 220. Such a pattern of blade assemblies 220 may be repeated around the circumference of the carrier ring e.g. with respect to the number of combustion burners. In particular, if a combustion burner exhausts the heated air in the vicinity of the blade assembly 220 that is located in the middle of the three blade assemblies 220 as shown in FIG. 3, the deflector 100 assigned to the middle blade assembly 220 may comprise first opening shapes and second opening shapes that provide a high amount of mass flow of the cooling fluid 106 in order to cool the blade devices 200, 210. The right and the left blade assemblies 220 as can be seen in FIG. 3 are more spaced from the combustion burner, so that a lower ambient heat is exerted to the blade devices 200, 210. Thus, the deflectors 100 assigned to the left blade assembly 220 and the right blade assembly 220 may comprise smaller opening regions 101, 102, so that the mass flow of the cooling fluid 106 is blocked more with respect to the opening regions 101, 102 of the blade assembly 220 that is located in the middle of the three blade assemblies 220.

FIG. 3 only illustrates three blade assemblies 220 forming a certain pattern of blade assemblies 220. Besides that, the pattern of blade assemblies 220 may comprise two blade assemblies or a plurality of more than three blade assemblies 220. Moreover, each pattern may be repeated around the whole circumference of carrier device 300, in particular the carrier ring.

Figure 4:
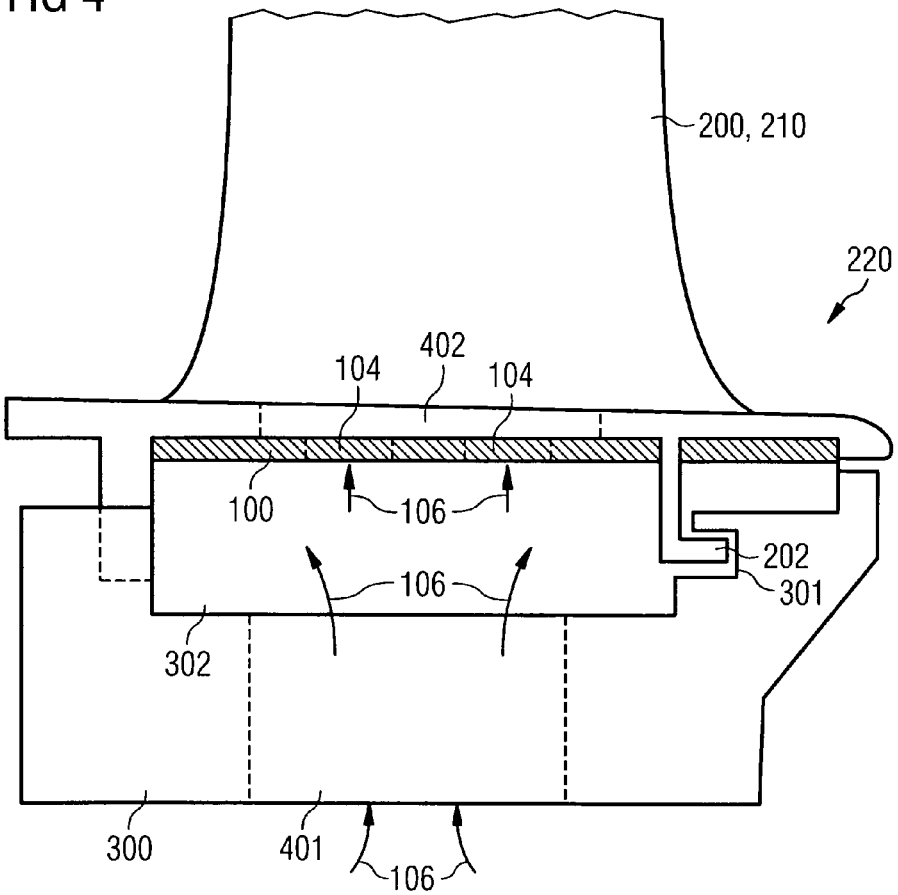
FIG. 4 illustrates an enlarged view of a blade assembly with a deflector according to an exemplary embodiment of the present invention.

FIG. 4 illustrates a side view of a blade assembly 220. The deflector 100 may be attached to a base area of the first and/or second blade device 200, 210. The carrier device 300 may comprise the inner carrier ring of a stator stage of a gas turbine. From the centre of the turbine, the cooling fluid 106 may be fed through a supply channel 401 into the carrier device 300. The cooling fluid 106 may be fed into the gap 302 from which the cooling fluid 106 is guided inside the blade devices 200, 210. Thereby, the cooling fluid 106 has to pass the deflector 100 and thus the first opening region 101 and the second opening region 102. The size respectively the first opening shape and the second opening shape are adapted to a predetermined installation location of the blade assembly 220 respectively the first blade device 200 and the second blade device 210 with respect to the turbine.

Moreover, as can be seen in FIG. 4 third connection means 202 are formed in a hook-like shape, wherein the third connection means 202 are either attached to the (base area) of the blade devices 200, 201 or to the deflector element 100. The third connection means 202 may fit to predetermined specific patterns of fourth connection means 301.

Besides, in FIG. 4 for a specific blade device 200, 210 two inlet holes 104 are indicated via dotted lines, forming a passage through the deflector 100. Furthermore a blade hole 402 through the base of the blade device 200, 210 is indicated also via dotted lines. The cross section of the blade hole 402 may be much wider than the cross section of the inlet holes 104. The mass flow through the blade device 200, 210 is still be determined by the cross section of the inlet holes 104.

The invention claimed is:

1. A gas turbine comprising:

a turbine stage, a combustor stage having a plurality of individual burners located circumferentially around the centre of the turbine stage, wherein the turbine stage comprises a plurality of nozzle guide assemblies, and a deflector for guiding a cooling fluid to aerofoils of the nozzle guide vane assemblies, the deflector comprising:

a first opening region with a first opening shape, wherein the first opening region comprises a pattern of inlet holes forming the first opening shape, and a second opening region with a second opening shape, wherein the second opening region comprises a further pattern of inlet holes forming the second opening shape, wherein the deflector is connectable to a aerofoil and to a second aerofoil in such a way that the cooling fluid is streamable through the pattern of inlet holes of the first opening region into the first aerofoil and the cooling fluid is streamable through the further pattern of inlet holes of the second opening region into the second aerofoil, wherein the first opening shape differs from the second opening shape for achieving a predetermined first mass flow of the cooling fluid into the first aerofoil and a predetermined second mass flow of the cooling fluid into the second blade aerofoil at predetermined installation locations of the first aerofoil and the second aerofoil, wherein the predetermined installation location of the first aerofoil is located in the centre of a hot exhaustion gas provided by a burner, and wherein the second aerofoil is located off-centre of a hot exhaustion gas provided by the burner.

2. The gas turbine of claim 1, further comprising:

a first specific pattern of a first connection means, wherein the first specific pattern corresponds to a second specific pattern of a second connection means at a predetermined installation location of the deflector in the turbine.

3. The gas turbine of claim 2, wherein the deflector comprises a third specific pattern of third connection means, wherein the carrier device comprises a fourth specific pattern of fourth connection means, and wherein the third specific pattern corresponds to the fourth specific pattern of fourth connection means at a predetermined installation location of the deflector.

4. The gas turbine of claim 1, further comprising:

a plurality of exhausting holes for exhausting cooling fluid to an environment of the first aerofoil and/or the second aerofoil for providing a film cooling on a supporting surface of the first aerofoil and/or the second aerofoil.

5. The gas turbine of claim 1, wherein the deflector is spatially fixable to a carrier device of the turbine.

6. The gas turbine of claim 1, wherein the deflector is spatially fixable to the first aerofoil and/or the second aerofoil.

7. The gas turbine of claim 1, wherein the deflector is integrally formed to the first aerofoil and/or the second aerofoil.

8. The gas turbine of claim 1, further comprising:

a carrier device, wherein the carrier device is mountable to the turbine and defines a predetermined installation location of the first aerofoil and the second aerofoil with respect to the turbine.

9. The gas turbine of claim 8, wherein the carrier device is a carrier ring.

10. The gas turbine of claim 8, wherein the deflector is interposed in between:

the first and second aerofoil, and the carrier device in such a way that a gap between the deflector and the carrier device is formed, so that cooling fluid is streamable through the gap.

11. The gas turbine of claim 1, wherein the inlet holes forming the second opening shape are smaller than the inlet holes forming the first opening shape.

12. A gas turbine comprising:

a turbine stage, a combustor stage having a plurality of individual burners located circumferentially around the centre of the turbine stage, wherein the turbine stage comprises a plurality of nozzle guide assemblies, and a deflector for guiding a cooling fluid to aerofoils of the nozzle guide vane assemblies, the deflector comprising:

a first opening region with a first opening shape, wherein the first opening region comprises a pattern of inlet holes forming the first opening shape, and a second opening region with a second opening shape, wherein the second opening region comprises a further pattern of inlet holes forming the second opening shape, wherein the deflector is connectable to a aerofoil and to a second aerofoil in such a way that the cooling fluid is streamable through the pattern of inlet holes of the first opening region into the first aerofoil and the cooling fluid is streamable through the further pattern of inlet holes of the second opening region into the second aerofoil, wherein the first opening shape differs from the second opening shape for achieving a predetermined first mass flow of the cooling fluid into the first aerofoil and a predetermined second mass flow of the cooling fluid into the second blade aerofoil at predetermined installation locations of the first aerofoil and the second aerofoil, wherein the predetermined installation location of the first aerofoil is located in the centre of a hot exhaustion gas provided by a burner, and wherein the second aerofoil is located in between two burners.

13. A deflector for guiding a cooling fluid to a blade device of a turbine, the deflector comprising:

a first opening region with a first opening shape, wherein the first opening region comprises a pattern of inlet holes forming the first opening shape, and a second opening region with a second opening shape, wherein the second opening region comprises a further pattern of inlet holes forming the second opening shape, wherein the deflector is connectable to a first blade device and to a second blade device in such a way that the cooling fluid is streamable through the pattern of inlet holes of the first opening region into the first blade device and the cooling fluid is streamable through the further pattern of inlet holes of the second opening region into the second blade device, wherein the first opening shape differs from the second opening shape for achieving a predetermined first mass flow of the cooling fluid into the first blade device and a predetermined second mass flow of the cooling fluid into the second blade device at predetermined installation locations of the first blade device and the second blade device, wherein the deflector further comprises:

a first specific pattern of a first connection means, wherein the first specific pattern corresponds to a second specific pattern of a second connection means at a predetermined installation location of the deflector in the turbine.

* * * * *